United States Patent [19]

Taggart

[11] 3,971,023

[45] July 20, 1976

[54] PARABOLIC REFLECTOR ASSEMBLED FROM TRIANGULAR SHAPED PETALS

[76] Inventor: Robert B. Taggart, 1789 Lark Lane, Sunnyvale, Calif. 94087

[22] Filed: Dec. 30, 1974

[21] Appl. No.: 537,094

[52] U.S. Cl. ..... 343/840; 343/915

[51] Int. Cl.[2] ..... H01Q 15/16; H01Q 15/20

[58] Field of Search ..... 343/840, 912, 914, 915, 343/916

[56] References Cited

UNITED STATES PATENTS

| | | | |
|---|---|---|---|
| 3,234,550 | 2/1966 | Thomas | 343/912 |
| 3,235,872 | 2/1966 | Schepis | 343/912 |
| 3,832,717 | 8/1974 | Taggart | 343/840 |

*Primary Examiner*—Eli Lieberman

*Attorney, Agent, or Firm*—F. D. LaRiviere

[57] ABSTRACT

Dish reflectors with high gain antennae comprising a plurality of generally triangular shaped petals joined in edgewise overlapping or abutting relation so as to form a substantially paraboloid configuration. Petal configuration is controlled by fastener holes positioned to bend the petal in a substantially parabolic manner along its longitudinal axis and in a substantially curvilinear manner along its transverse axis.

8 Claims, 14 Drawing Figures

PARABOLIC REFLECTOR ASSEMBLED FROM TRIANGULAR SHAPED PETALS

BACKGROUND & SUMMARY OF THE INVENTION

Low-cost, high-gain antenna reflector designs exist in the prior art. One such design is disclosed in U.S. Pat. No. 3,832,717 issued to the inventor hereof Aug. 27, 1974. That design offered the advantages of low cost, light weight and convenient assembly in the field while providing relatively high gain performance up to approximately 4 GHz. However, that reflector, comprising a plurality of generally triangular petals assembled in slightly overlapping relationship, attained only a "quasi-paraboloid" shape which reduces its gain characteristics above 4 GHz. In order to achieve useable gain at frequencies in the 12 GHz region, a reflector having a conformation more closely approaching a true paraboloid is necessary.

True parabolic antennae typically require substantial truss support structure and are expensive to manufacture. The parabolic reflector of the present invention requires no support truss and, by improving the basic design concept of the above-mentioned U.S. patent, achieves substantially parabolic shape over the entire surface of the reflector without appreciably increasing manufacturing cost, complicating field assembly or increasing shipping weight.

One embodiment of the present invention comprises a plurality of greatly overlapping, generally triangular-shaped petals having precisely sized and positioned holes in the overlap region through which a set of fasteners are inserted to locate one petal relative to the next and to bend adjacent petals elastically to provide curvilinear transverse shape therein. For this embodiment the petals may be interlaced or alternately overlayed. Another embodiment of the present invention comprises a layer of generally triangular shaped petals coupled to a second fully overlapping layer of similar shaped petals, the layers being rigidly held together in substantially parabolic conformation by fasteners inserted through commonly and precisely sized and positioned holes through the petals of both layers. For each embodiment, a rigid, segmented exterior rim formed to receive the outer edges of the assembled petals provides the necessary mechanical structure for mounting and positioning the reflector and for maintaining mechanical integrity over a wide range of environmental conditions.

Before assembly of either configuration reflector, each petal is essentially a flat sheet of light-weight, flexible, relatively thin, electromagnetically reflective material such as aluminum. The ultimate reflector configuration is determined by the precisely positioned fasteners in each petal or, alternatively in the case of the two-layer configuration wherein the inner layer petals edgewise abutt, by the shape of the abutting petal edges. Thus, by controlling the locating of the holes in the petals and the shape of the petal edges, the shape of the reflector is controlled and adjusted as desired.

DESCRIPTION OF THE PREFERRED EMBODIMENTS

Figure 1:
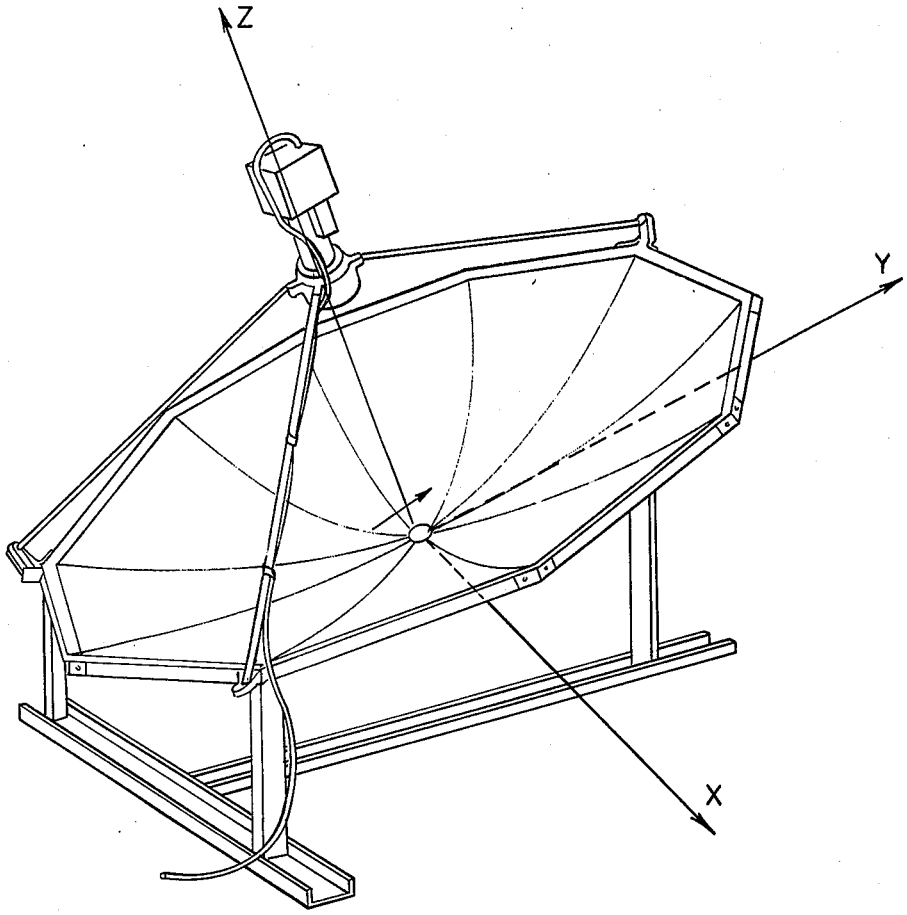
Figure 1 PRIOR ART
FIG. 1 is a perspective view of a microwave antenna incorporating a prior art quasi-paraboloid dish reflector.
Figure 2A:
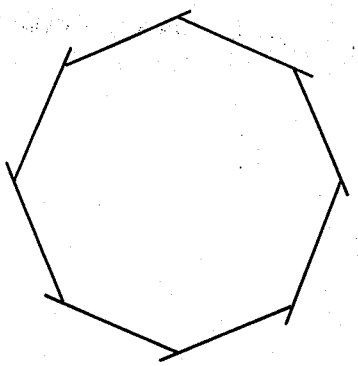
PRIOR ART Figure 2a
FIG. 2*a* is a top view of an eight-petal quasi-paraboloid reflector constructed according to FIG. 1 taken at the intersection of the petals with a plane perpendicular to the focal axis of that reflector prior to assembly.
Figure 2B:
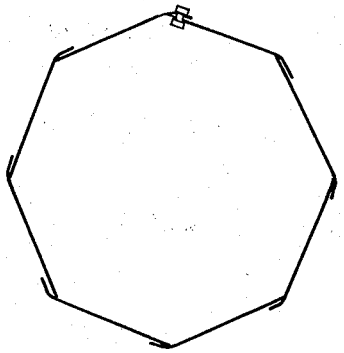
PRIOR ART Figure 2b
FIG. 2*b* is a top view of the eight-petal configuration of FIG. 2*a* after assembly.

In the quasi-parabolic reflector of U.S. Pat. No. 3,832,717, each petal slightly overlapped adjacent petals for conveniently indexing the petals to one another during assembly. The overlap was so small that, after assembly, a small, transverse, petal-to-petal angle resulted (refer to FIGS. 1, 2*a* and 2*b*) because the overlapped portion of each petal would simply inelastically bend to the angle of the adjacent petal. No smooth, curved bending occurred along common transverse axes of the adjacent petals.

Figure 3A:
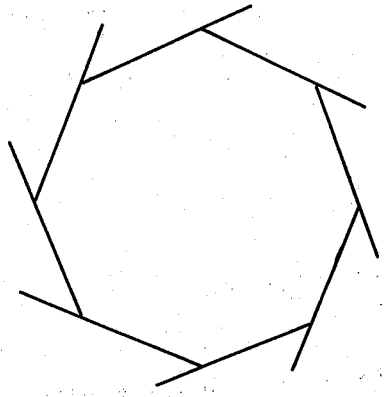
FIG. 3*a* is a top view of an eight-petal paraboloid reflector constructed according to one embodiment of the present invention having interlaced petals taken at the intersection of the petals with a plane perpendicular to the focal axis of that reflector prior to assembly.
Figure 3B:
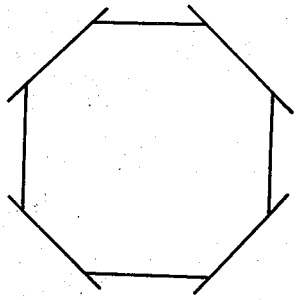
FIG. 3*b* is a top view of an eight-petal paraboloid reflector constructed according to one embodiment of the present invention having alternately overlayed petals taken at the intersection of the petals with a plane perpendicular to the focal axis of that reflector prior to assembly.
Figure 3C:
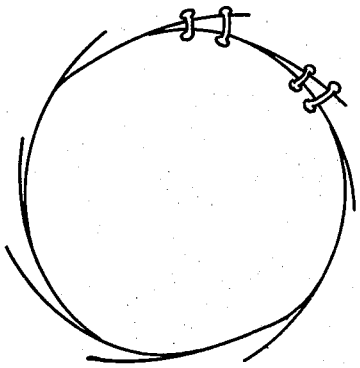
FIG. 3*c* is a top view of the reflector configuration of FIG. 3 during assembly showing curvilinear transverse petal shape

Referring now to FIGS. 3*a* and 3*c*, as the interlaced overlap is increased and the petals are fastened with two fasteners, such as rivets or nuts and bolts, at each fastening position in the overlap region, the petals are forced to bend in the transverse direction as shown. The number of fasteners used at each position is essentially arbitrary taking into consideration petal material and thickness. The transverse direction (i.e. axis) is perpendicular to the longitudinal axis of the petal. If the hole positions are located accurately, the petals will form a substantially parabolic reflector. Thus the surface of a reflector need not be preformed using expensive dies. No metal spinning operations are needed nor stretch forming. These operations are costly, particularly for reflectors having a diameter greater than ten feet. When fasteners are installed in the alternately overlayed petal configuration of FIG. 3*b*, transverse bending is obtained in essentially the same manner.

The reflector design of FIGS. 3*a* and 3*b* results from the combined effects of petal overlap, fastener hole positions, the number of petals and the thickness of the petal material. The transverse bending or curvilinear shape of the petals may be explained by analogy to the bending of beams.

Figure 4A:
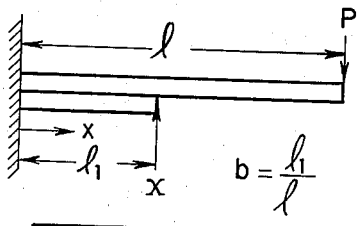
FIG. 4*a* is a side view of two cantilever beams attached to the same anchor wall.
Figure 4B:
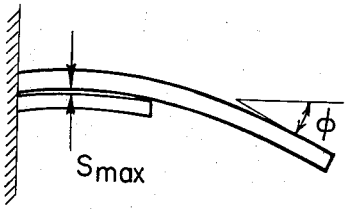
FIG. 4*b* is a side view of the top beam of FIG. 4*a* in bent configuration.

Suppose two cantilever beams are attached to the same wall one above the other as shown in FIG. 4*a*. The bottom beam is shorter than the top beam. Also suppose $b$ is the ratio of the length of the bottom beam to the length of the top beam. ($b$ is analogous to the amount of overlap of one petal over the adjacent petal.) As the top beam is bent such that the end is bent down by an angle $\phi$ as shown in FIG. 4*b*, a gap or space S, will begin to develop between the top and bottom beams (or petals). The maximum amount of this gap is given by the following relation derived from beam theory.

$$S_{max} = \phi l \frac{16b^3(3-2b)}{81(2b^2-3b+3)} \qquad \text{(A)}$$

where $l$ is the length of the top beam

This space between beams (or petals) can be made as small as possible by reducing $\phi$, $l$, and/or $b$ so that there is no abrupt change in the slope of the inner surface from one beam (petal) to the next. Reducing $\phi$ may be achieved by using a greater number of petals. Reducing $l$ may be achieved by reducing the diameter of the antenna or using more petals (increasing $n$). Reducing $b$ will reduce the amount of overlap bu may not be desirable because this is what cause the transverse bending. Thus, some trade off among the variables to achieve the best combination is necessary. A complete derivation of equation A is given in Appendix A to this specification.

If The local yield point stress of the petal material is exceeded during assembly, the petal will be permanently deformed which is undesirable because any such local yielding would indicate a non-uniform stress and/or bending moment which would cause non-uniformity in the curvature of the reflector surface. The maximum stress throughout the petal after assembly should be kept below the endurance limit stress or yield point. The maximum stress in the petals is defined by the relationship:

$$\sigma_x = \frac{Et}{4(1-\nu)Z_o}, \qquad \text{(B)}$$

where $\nu$ is Poisson's ration, $Z_o$ is focal length, $E$ is the elastic modulus of the material and $t$ is the thickness of the petals. A derivation of this equation is given in Appendix B.

After selecting the number of sections and overlap $b$, $\phi$ may be determined from $$\tan\left(\frac{\phi}{2}\right) = \frac{r}{2Z_o}\left[\frac{\tan\left(\frac{180°}{n}\right)}{1+\frac{r^2}{4Z_o^2}}\right]$$

where $r$ is the radial distance to any point on the line $Z = r^2/4Z_o$ rotated about the $Z$ axis and $Z_o$ is the focal length of the parabolic surface of revolution. The maximum value of $r$ is the radius of the antenna.

$l$ may be determined from $$l = 2r \tan \frac{180°}{n}$$

It is apparent from relationships A and B that the trade off is between $\phi$, $l$, $n$, and $t$, where $S_{max} < t$ to provide smooth transition from petal-to-petal on the reflector surface.

Knowing the radius of the dish, the maximum space that will exist between the overlapping edges of adjacent petals may be calculated using equation A. Using equation B, the maximum stress may be determined after selecting material E of thickness $t$. The thickness $t$ is reduced until the maximum stress is substantially below the elastic limit and/or yield point. By keeping $S_{max}$ less than $t$ the overlap will provide a close and essentially smooth transition from petal-to-petal. This will enhance the conditions necessary for an accurate parabolic surface. If after making the calculation with equation A, the $S_{max}$ may be larger than desirable; if so, it may be desirable to reduce $S_{max}$ by increasing the number of petals, $n$.

The maximum transverse deflection or bending of a petal along any transverse axis at its intersection with the longitudinal axis is given by:

$$\delta = \frac{\pi^2 r^2}{2n^2\sqrt{r^2+4Z_o^2}} \qquad \text{(C)}$$

where $n$ = the number of petals, $Z_o$ = the focal length of the reflector, and $\delta < t$ to preclude permanent deformation of the petals. The derivation of equation (C) is given in Appendix C.

The positions of the holes in the petals are now determining from the following relation. If, for example, the radius of the antenna (9.2 fee) is divided into 23 equally spaced lengths, the distance R to each of those 23 positions on the surface of the parabola from the center can be determined by:

$$R = \int_o^r \sqrt{1+\left(\frac{dZ}{dr}\right)^2 dr} \qquad \text{(D)}$$

where $Z = r^2/4Z_0$, $dZ/dr = r/2Z_0$ and $r$ = projection of R on the r-axis after petal is bent longitudinally.

Figure 5:
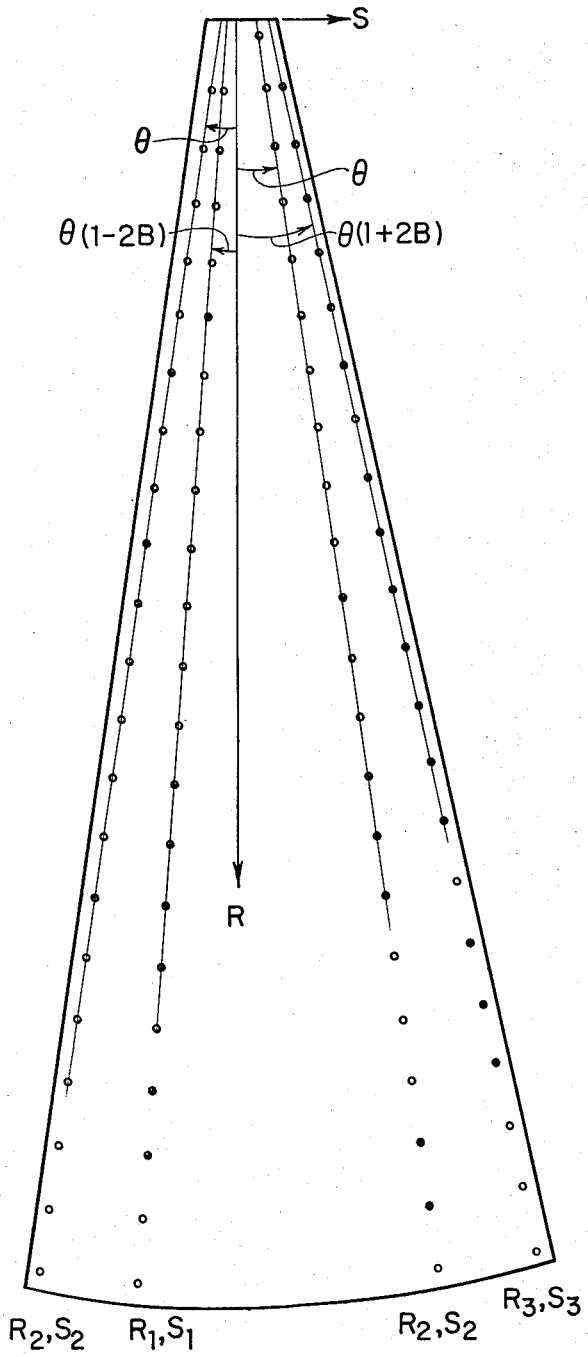
FIG. 5 is a top view of a petal constructed according to one embodiment of the present invention.

Thus, for each $r$ an $R$ may be calculated. Referring to FIG. 5, a value of $\theta$ is now calculated for each $r$ from the following equation:

$$\theta = (180°\ r)/nR$$

The R and S positions of each hole position are labeled as $R_1$, $S_1$ and $R_2$, $S_2$ and $R_3$ as shown in FIG. 5. These positions are calculated from the following relationships:

$$R_1 = R\cos[\theta(1-2b)]-0.7 \qquad R_2 = R\cos\theta - 0.7 \qquad R_3 = R\cos[\theta(1+2b)]-0.7$$
$$S_1 = R\sin[\theta(1-2b)] \qquad S_2 = R\sin\theta \qquad S_3 = R\sin[\theta(1+2b)]$$

where $b$ is the ratio of the overlap to the width of the petal at the fastening point. The constant 0.7 arises from the presence of a circular hole at the center of the assembled reflector. Table I summarized the precise hole positions for each of 80 petals in the example reflector to achieve curvilinear transverse shape in each of those petals.

TABLE I

| | $r$ | $R$ | $R_1$ | $S_1$ | $R_2$ | $S_2$ | $R_3$ | $S_3$ |
|---|---|---|---|---|---|---|---|---|
| 1 | 0.400 | 0.400 | | 0.010 | | 0.021 | | 0.031 |
| 2 | 0.800 | 0.800 | 0.100 | 0.021 | 0.099 | 0.042 | 0.098 | 0.063 |
| 3 | 1.200 | 1.201 | 0.501 | 0.031 | 0.500 | 0.063 | 0.498 | 0.094 |
| 4 | 1.600 | 1.603 | 0.902 | 0.042 | 0.901 | 0.084 | 0.898 | 0.126 |
| 5 | 2.000 | 2.006 | 1.305 | 0.052 | 1.303 | 0.105 | 1.299 | 0.157 |
| 6 | 2.400 | 2.410 | 1.709 | 0.063 | 1.706 | 0.126 | 1.702 | 0.108 |
| 7 | 2.800 | 2.815 | 2.114 | 0.073 | 2.112 | 0.147 | 2.107 | 0.220 |
| 8 | 3.200 | 3.223 | 2.522 | 0.084 | 2.519 | 0.167 | 2.513 | 0.251 |
| 9 | 3.600 | 3.633 | 2.931 | 0.094 | 2.928 | 0.188 | 2.922 | 0.282 |
| 10 | 4.000 | 4.045 | 3.343 | 0.105 | 3.339 | 0.209 | 3.333 | 0.314 |
| 11 | 4.400 | 4.459 | 3.758 | 0.115 | 3.754 | 0.230 | 3.746 | 0.345 |
| 12 | 4.800 | 4.877 | 4.175 | 0.126 | 4.171 | 0.251 | 4.162 | 0.377 |
| 13 | 5.200 | 5.298 | 4.596 | 0.136 | 4.591 | 0.272 | 4.582 | 0.403 |
| 14 | 5.600 | 5.722 | 5.020 | 0.147 | 5.014 | 0.293 | 5.005 | 0.489 |
| 15 | 6.000 | 6.149 | 5.447 | 0.157 | 5.441 | 0.314 | 5.421 | 0.471 |
| 16 | 6.400 | 6.581 | 5.879 | 0.168 | 5.872 | 0.335 | 5.861 | 0.502 |
| 17 | 6.800 | 7.816 | 6.314 | 0.178 | 6.307 | 0.356 | 6.296 | 0.534 |
| 18 | 7.200 | 7.456 | 6.753 | 0.188 | 6.746 | 0.377 | 6.734 | 0.565 |
| 19 | 7.600 | 7.900 | 7.197 | 0.199 | 7.190 | 0.398 | 7.177 | 0.596 |
| 20 | 8.000 | 8.348 | 7.646 | 0.209 | 7.638 | 0.419 | 7.625 | 0.628 |
| 21 | 8.400 | 8.802 | 8.099 | 0.220 | 8.091 | 0.440 | 8.077 | 0.659 |
| 22 | 8.800 | 9.260 | 8.557 | 0.230 | 8.549 | 0.461 | 8.534 | 0.691 |
| 23 | 9.200 | 9.724 | 9.021 | 0.241 | 9.012 | 0.482 | 8.997 | 0.722 |

Figure 6A:
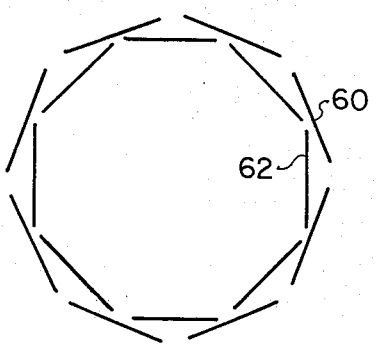
FIG. 6*a* is a top view of a two-layer, 16 petal paraboloid reflector constructed according to another embodiment of the present invention taken at the intersection of the petals with a plane perpendicular to the focal axis of that reflector prior to assembly.
Figure 6B:
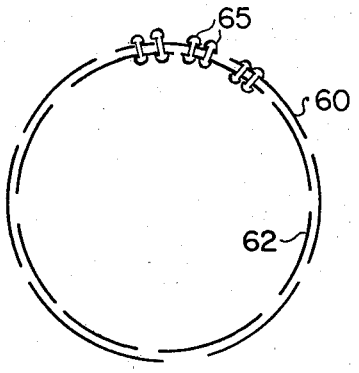
FIG. 6*b* is a top view of the reflector configuration of FIG. 6*a* after assembly.

In the configuration of FIGS. 6*a* and 6*b*, a second layer of essentially identical petals has been added to effectively fully overlap each of the petals in the configuration of FIGS. 3*a* and 3*b*. Outer layer of petals 60 is fastened to inner layers of petals 62 by two fasteners (for example, 65) at each fastening position in the overlap region of adjacent petals. The precisely sized and positioned holes serve to index the petals of inner layer 62 to each other when fastened to the petals of outer layer 60, and to cause transverse bending of each petal in the reflector which essentially eliminates petal-to-petal angles when tightly fastened. Equation (C) derived for the greatly overlapped configuration also describes the transverse bending of the petals in layers 60 and 62.

Outer layer 60 also provides structural support for the reflector, eliminating the need for supporting truss. The petals of inner layer 62 are constructed to essentially edgewise abutt one another to eliminate petal-to-petal discontinuities at the reflecting surface which enhances the gain characteristics of the antenna.

Since the sheet materials respond non-linearly when deflection, $\delta$, is greater than thickness, $t$, much more force is required to achive such deflection than for $\delta$ less than $t$. In addition, there is substantial risk of exceeding yield point stress and permanently deforming the material. Therefore, the bending of the petal material should be kept within the linear ($\delta < 2t$ for this fully overlapping configuration) bending range of the material to facilitate field assembly and to avoid support trusses which are necessary to apply greater force yet increase weight and cost. Since the petals of the reflector are to be bent longitudinally as well as transversely, the deflection for a selected number of petals defines $t$. If $t$ is too large the bending moment to attain transverse petal deflection would increase beyond the limits of field assembly without special tools, jigs and skilled labor. Therefore, $n$ should be increased to reduce $\delta$ which in turn reduces $t$ to facilitate field assembly. Table II gives the maximum transverse deflection of the petals at 10 inch increments of $r$ according to equation (C) for a 10 foot diameter reflector comprising up to 80 petals.

TABLE II

| | $n=20$ | $n=30$ | $n=40$ | $n=60$ | $n=80$ |
|---|---|---|---|---|---|
| $r=20''$ | 0.050 | 0.022 | 0.013 | 0.006 | 0.003 |
| $r=30''$ | 0.110 | 0.049 | 0.028 | 0.012 | 0.007 |
| $r=40''$ | 0.190 | 0.084 | 0.047 | 0.021 | 0.012 |
| $r=50''$ | 0.285 | 0.127 | 0.071 | 0.032 | 0.018 |
| $r=60''$ | 0.392 | 0.174 | 0.098 | 0.044 | 0.025 |

It should be noted also that $\delta$ increases along the longitudinal axis toward the outer rim of the reflector. The point at which $\delta = 2t$ can be controlled by appropriate selection of the parameters discussed above. For this embodiment of the present invention, this point is at the rim along the longitudinal axis of the petal.

Figure 7:
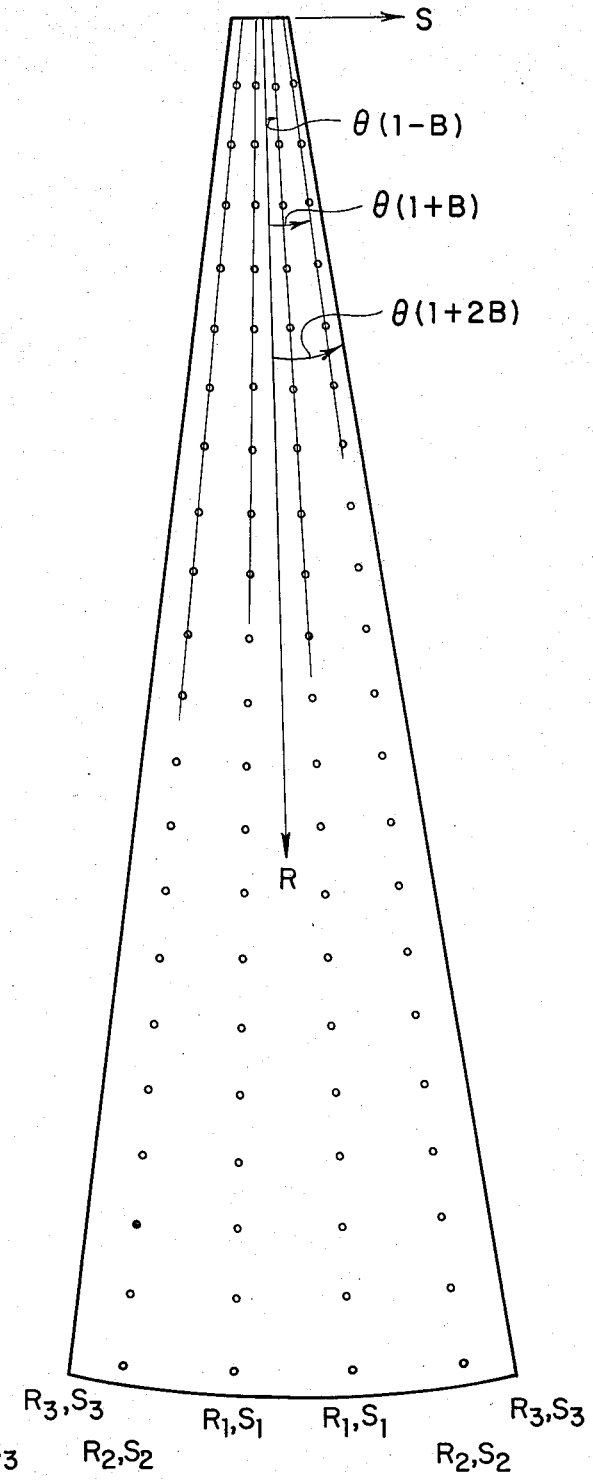
FIG. 7 is a top view of a petal constructed according to another embodiment of the present invention.

The hole positions are determined by the relations given below:

$$R_1 = R\cos[\theta(1-b)]-A \qquad R_2 = R\cos[\theta(1+B)]-A$$
$$S_1 = R\sin[\theta(1-B)] \qquad S_2 = R\sin[\theta(1+B)]$$

Where $A$ = the radius of the hole in the center of the dish $B = 0.5$, the ratio of petal overlap to petal width $R$ is determined by equation (D) $\theta = \pi r/nR$ Referring to FIG. 7, Table III gives the hole positions for the petals in both the outer and inner layers of petals for a 10 foot diameter reflector having a total of 40 petals and a prabolic focal length, $Z_o$, of 48 inches as determined by the above relations.

TABLE III

| | $r$ | $R$ | $R_1$ | $S_1$ | $R_2$ | $S_2$ |
|---|---|---|---|---|---|---|
| 1 | 7.500 | 7.508 | 3.127 | 0.294 | 3.081 | 0.882 |
| 2 | 10.000 | 10.018 | 5.635 | 0.393 | 5.574 | 1.175 |
| 3 | 12.500 | 12.535 | 8.151 | 0.491 | 8.074 | 1.469 |
| 4 | 15.000 | 15.061 | 10.674 | 0.589 | 10.582 | 1.763 |
| 5 | 17.500 | 17.596 | 13.208 | 0.687 | 13.101 | 2.057 |
| 6 | 20.000 | 20.144 | 15.753 | 0.785 | 15.631 | 2.351 |
| | $r$ | $R$ | $R_1$ | $S_1$ | $R_2$ | $S_2$ |
| 7 | 22.500 | 22.704 | 18.312 | 0.883 | 18.175 | 2.645 |
| 8 | 25.000 | 25.280 | 20.886 | 0.982 | 20.733 | 2.939 |
| 9 | 27.500 | 27.872 | 23.476 | 1.080 | 23.309 | 3.232 |
| 10 | 30.000 | 30.481 | 26.084 | 1.178 | 25.902 | 3.526 |
| 11 | 32.500 | 33.111 | 28.711 | 1.276 | 28.514 | 3.820 |

TABLE III-continued

| | | | | | | |
|---|---|---|---|---|---|---|
| 12 | 35.000 | 35.761 | 31.359 | 1.374 | 31.148 | 4.114 |
| 13 | 37.500 | 38.433 | 34.030 | 1.472 | 33.804 | 4.408 |
| 14 | 40.000 | 41.129 | 36.724 | 1.570 | 36.484 | 4.702 |
| 15 | 42.500 | 43.850 | 39.443 | 1.669 | 39.190 | 4.996 |
| 16 | 45.000 | 46.597 | 42.189 | 1.767 | 41.921 | 5.290 |
| 17 | 47.5000 | 49.373 | 44.962 | 1.865 | 44.681 | 5.584 |
| 18 | 50.000 | 52.176 | 47.765 | 1.963 | 47.469 | 5.878 |
| 19 | 52.500 | 55.010 | 50.597 | 2.061 | 50.288 | 6.172 |
| 20 | 55.000 | 57.876 | 53.460 | 2.159 | 53.138 | 6.466 |
| 21 | 57.500 | 60.773 | 56.356 | 2.258 | 56.021 | 6.760 |
| 22 | 60.000 | 63.704 | 59.286 | 2.356 | 58.938 | 7.054 |

The material used for this embodiment is 5052 H32 aluminum sheet, having thickness, $t = 0.050$ inches. Holes $S_1$ and $S_2$ are located within $\pm 0.002$ inches and $S_3$ dimension is located within $\pm 0.002$ inches; holes $R_1$ and $R_2$ and dimension $R_3$ are located within $\pm$ 0.002 inches for positions 1–8, within $\pm$ 0.005 inches for positions 9–12 and within $\pm 0.010$ for positions 13–22. $R_1$, $S_1$ and $R_2$, $S_2$ holes are 0.187/0.189 inch.

For the fully overlapping configuration, where the abutting petal edges are essentially rectilinear, the fastener hole positions and sizes must be precisely located to achieve paraboloidal shape. However, if the petal edges are slightly curved outwardly from the longitudinal axis of the petals, precise hole positions would be required only near the center and the outer rim of the assembled reflector (i.e. near the narrowest and widest portions of each petal, respectively) to achieve the same shape. Precise abutting of the curved petal edges rather than precise intermediate hole locations and sizes establishes the paraboloidal shape after assembly. Then, since the intermediate fasteners now merely maintain the transverse bending of the petal in the overlap region, those fasteners could be of smaller diameter or the holes therefor could be larger to facilitate assembly. After installation of fasteners at the narrowest and widest portions of the petals, the assembler simply bends the petal appropriately so that the petals of the inside layer abutt and the intermediate fasteners are inserted.

The shape of the slightly curved petal edges are defined by:

$$R_3 = R\cos\,[\theta\,(1+2B)] - A$$

$$S_3 = R\sin\,]\theta(1+2B)]$$

where $A$, $B$, $R$ and $\theta$ are defined as above. Again referring to FIG. 7, Table IV gives values for the $R_3$ and $S_3$ dimensions corresponding to the $R_1$, $S_1$ and $R_2$, $S_2$ hole positions given in Table III for a petal having curved edges for uses in the reflector configuration of FIGS. 6*a* and 6*b*.

TABLE IV

| $R_3$ | $S_3$ |
|---|---|
| 3.040 | 1.173 |
| 5.520 | 1.564 |
| 8.007 | 1.955 |
| 10.502 | 2.347 |
| 13.007 | 2.738 |
| 15.524 | 3.129 |
| 18.055 | 3.520 |
| $R_3$ | $S_3$ |
| 20.600 | 3.911 |
| 23.163 | 4.302 |
| 25.743 | 4.694 |
| 28.343 | 5.085 |
| 30.964 | 5.476 |
| 33.607 | 5.867 |
| 36.275 | 6.259 |
| 38.968 | 6.650 |
| 41.687 | 7.042 |
| 44.435 | 7.433 |
| 47.211 | 7.824 |
| 50.018 | 8.216 |
| 52.857 | 8.607 |
| 55.728 | 8.999 |
| 58.633 | 9.390 |

Referring again to FIG. 7, Table V gives the same data as Table III for a 40 foot diameter reflector having a total of 80 petals and a focal length, $Z_o$, of 192 inches.

TABLE V

| | r | R | $R_1$ | $S_1$ | $R_2$ | $S_2$ | $R_3$ | $S_3$ |
|---|---|---|---|---|---|---|---|---|
| 1 | 30.00 | 30.03 | 2.52 | 0.59 | 2.48 | 1.77 | 2.44 | 2.35 |
| 2 | 37.50 | 37.56 | 10.05 | 0.74 | 9.99 | 2.21 | 9.94 | 2.94 |
| 3 | 45.00 | 45.10 | 17.59 | 0.88 | 17.52 | 2.65 | 17.46 | 3.53 |
| 4 | 52.50 | 52.66 | 25.15 | 1.03 | 25.07 | 3.09 | 25.00 | 4.12 |
| 5 | 60.00 | 60.24 | 32.73 | 1.18 | 32.64 | 3.53 | 32.56 | 4.71 |
| 6 | 67.50 | 67.85 | 40.33 | 1.33 | 40.23 | 3.97 | 40.14 | 5.30 |
| 7 | 75.00 | 75.47 | 47.96 | 1.47 | 47.84 | 4.42 | 47.74 | 5.88 |
| 8 | 82.50 | 83.13 | 55.61 | 1.62 | 55.49 | 4.86 | 55.38 | 6.47 |
| 9 | 90.00 | 90.82 | 63.30 | 1.77 | 63.16 | 5.30 | 63.04 | 7.06 |
| 10 | 97.50 | 98.54 | 71.02 | 1.91 | 70.87 | 5.74 | 70.74 | 7.65 |
| | r | R | $R_1$ | $S_1$ | $R_2$ | $S_2$ | $R_3$ | $S_3$ |
| 11 | 105.00 | 106.29 | 78.77 | 2.06 | 78.61 | 6.18 | 78.47 | 8.24 |
| 12 | 112.50 | 114.09 | 86.57 | 2.21 | 86.40 | 6.62 | 86.25 | 8.83 |
| 13 | 120.00 | 121.93 | 94.40 | 2.36 | 94.22 | 7.06 | 94.06 | 9.42 |
| 14 | 127.50 | 129.81 | 102.28 | 2.50 | 102.09 | 7.51 | 101.92 | 10.00 |
| 15 | 135.00 | 137.73 | 110.21 | 2.65 | 110.00 | 7.95 | 109.82 | 10.59 |
| 16 | 142.50 | 145.71 | 118.18 | 2.80 | 117.96 | 8.39 | 117.78 | 11.18 |
| 17 | 150.00 | 153.73 | 126.20 | 2.95 | 125.98 | 8.83 | 125.78 | 11.77 |
| 18 | 157.50 | 161.81 | 134.28 | 3.09 | 134.04 | 9.27 | 133.84 | 12.36 |
| 19 | 165.00 | 169.95 | 142.41 | 3.24 | 142.17 | 9.71 | 141.95 | 12.95 |
| 20 | 172.50 | 178.14 | 150.61 | 3.39 | 150.35 | 10.16 | 150.12 | 13.54 |
| 21 | 180.00 | 186.39 | 158.86 | 3.53 | 158.59 | 10.60 | 158.35 | 14.12 |
| 22 | 187.50 | 194.70 | 167.17 | 3.68 | 166.89 | 11.04 | 166.65 | 14.71 |
| 23 | 195.00 | 203.08 | 175.55 | 3.83 | 175.26 | 11.48 | 175.01 | 15.30 |
| 24 | 202.50 | 211.53 | 183.99 | 3.98 | 183.69 | 11.92 | 183.43 | 15.89 |
| 25 | 210.00 | 220.04 | 192.50 | 4.12 | 192.19 | 12.36 | 191.92 | 16.48 |
| 26 | 217.50 | 228.63 | 201.09 | 4.27 | 200.77 | 12.81 | 200.49 | 17.07 |
| 27 | 225.00 | 237.28 | 209.74 | 4.42 | 209.41 | 13.25 | 209.12 | 17.66 |
| 28 | 232.50 | 246.01 | 218.47 | 4.56 | 218.13 | 13.69 | 217.83 | 18.24 |
| 29 | 240.00 | 254.82 | 227.27 | 4.71 | 226.93 | 14.13 | 226.62 | 18.83 |

APPENDIX A

Referring to FIG. 4a, generally, $$EI_z \frac{d^2y}{dx^2} = -M$$

and $$M = P(l-x) - \chi(l_1-x) \quad O \quad x \quad l_1$$
$$M = P(l-x) \quad l \quad x \quad l$$

For the top beam $$\delta_T = \frac{1}{ET_z} \left[P(l-x)x \frac{x}{2} + \frac{1}{2} Px\, x \frac{2x}{3} - \chi(l_1-x)\, x \frac{x}{2} - \frac{1}{2} \chi_3 x^2 \frac{2x}{}\right]$$
$$= \frac{1}{EI_z} \left[P(l-x) \frac{x^2}{2} + \frac{Px^2}{2} \frac{2x}{3} - \chi(l_1-x) \frac{x^2}{2} - \frac{\chi x^2}{2} \frac{2x}{3}\right]$$
$$= \frac{1}{EI_z} \left[P\left( \frac{lx^2}{2} - \frac{x^3}{6}\right) - \chi\left( \frac{l_1x^2}{2} - \frac{x^3}{6}\right)\right]$$

For the bottom beam $$\delta_B = \frac{1}{EI_z} \left[\chi(l_1-x)x \frac{x}{2} + \frac{1}{2} \chi\, x \cdot x \frac{2x}{3}\right]$$
$$= \frac{1}{EI_z} \left[\chi(l_1-x) \frac{x^2}{2} + \chi \frac{x^2}{2} \frac{2x}{3}\right]$$
$$= \frac{1}{EI_z} \left[\chi\left( \frac{l_1x^2}{2} - \frac{x^3}{6}\right)\right]$$

$$\Delta\delta = \delta_T - \delta_B = \frac{1}{EI_z} \left[P\left( \frac{lx^2}{2} - \frac{x^3}{6}\right) - 2\chi \frac{l_1x^2}{2} - \frac{x^3}{6}\right)\right]$$

$$\frac{d\Delta\delta}{dx} = O = \frac{1}{EI_z} \left[P\left(lx - \frac{x^2}{2}\right) - 2\chi\left(l_1x - \frac{x^2}{2}\right)\right]$$

$$P\left(lx - \frac{x^2}{2}\right) - 2\chi\left(l_1x - \frac{x^2}{2}\right) = O$$

$$\chi = \frac{3P}{4} \left( \frac{l}{l_1} - \frac{1}{3}\right)$$

$$\left(lx - \frac{x^2}{2}\right) - \frac{3}{2} \left( \frac{l}{l_1} - \frac{1}{3}\right) \left(l_1x - \frac{x^2}{2}\right) = O$$

Thus, $$\left(l - \frac{x}{2}\right) = \frac{3}{2} \left(\frac{l}{l_1} - \frac{1}{3}\right) \left(l_1 - \frac{x}{2}\right)$$

or $$2l - x = 3l - \frac{3l}{l_1} \frac{x}{2} - l_1 + \frac{x}{2}$$

Therefore, $$x = \frac{2}{3} l_1$$

$$\Delta\delta = \frac{1}{EI_z} \left[P\left( \frac{lx^2}{2} - \frac{x^3}{6}\right) - 2\chi\left( \frac{l_1x^2}{2} - \frac{x^3}{6}\right)\right]$$

$$\chi = \frac{3P}{4} \left( \frac{l}{l_1} - \frac{1}{3}\right)$$

$$\Delta\delta\left(x = \frac{2}{3} l_1\right) = S_{max}$$

$$S_{max} = \frac{P}{EI_z} \left[\left( \frac{lx^2}{2} - \frac{x^3}{6}\right) - \frac{3}{2} \left( \frac{l}{l_1} - \frac{1}{3}\right) \left( \frac{l_1x^2}{2} - \frac{x^3}{6}\right)\right]$$

$$\text{At } x = \frac{2l_1}{3},\ S_{max} = \frac{P}{EI_z} \left[\frac{2ll_1^2}{9} - \frac{4l_1^3}{81} - \left( \frac{3l}{2l_1} - \frac{1}{2}\right) \frac{16}{81} l_1^3\right]$$

$$\text{or } S_{max} = + \frac{Pl_1^2}{EI_z} \left[- \frac{2l}{27} + \frac{4l_1}{81}\right]$$

assume $l_1 = bl$ $$S_{max} = + \frac{Pl^3}{EI_z} b^2 - \left[\frac{2}{27} + \frac{4b}{81}\right] = \frac{Pl^3b^2}{27EI_z} \left( \frac{4b}{3} - 2\right) \quad 0 \leq b \leq l$$

$$\phi = \left.\frac{dy}{dx}\right|_{x=l}$$

$$\phi = \left.\frac{dy}{dx}\right|_{x=l} = \frac{1}{EI_z} \left[P\left(lx - \frac{x^2}{2}\right) - \chi\left(l_1x - \frac{x^2}{2}\right)\right]_{x=l}$$

$$= \frac{1}{EI_z} \left[P \frac{l^2}{2} - \chi\left(l_1l - \frac{l^2}{2}\right)\right]$$

-continued $$= \frac{1}{EI_z}\left[P\ \frac{l^2}{2} - \frac{3P}{4}\left(\frac{l}{l_1} - \frac{1}{3}\right)\left(l_1 l - \frac{l^2}{2}\right)\right]$$

Since $\chi = \frac{3P}{4}\left(\frac{l}{l_1} - \frac{1}{3}\right)$.

Simplifying, $\phi = \frac{P}{EI_z}\left[\frac{3}{8} l^2 \left(\frac{1-b}{b} + \frac{bl^2}{4}\right)\right]$ Then, $\frac{P}{EI_z} = \frac{\phi}{l^2} - \frac{8b}{2b^2 - 3b + 3}$ and $S_{max} = \frac{Pl^3b^2}{27EI_z}\left(\frac{18}{4b/3} - 2\right) = \frac{Pl^3b^2}{81EI_z}(4b - 6)$ $$S_{max} = \frac{\phi}{l^2}\ \frac{8b}{2b^2 - 3b + 3}\ \frac{l^3b^2}{81}(4b - 6)$$

$$S_{max} = \phi l\ \frac{16b^3(2b - 3)}{81(2b^2 - 3b + 3)}$$

APPENDIX B

Figure 9:
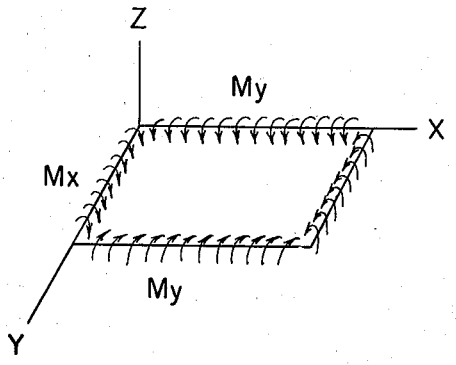
FIG. 9 is a perspective view of a rectangular plate subjected to uniform bending moments.

Referring to FIG. 9, a rectangular plate is subjected to pure bending by moments that are uniformly distributed along the edges of the plate. In a plate undergoing such pure bending the magnitude of the maximum stresses is given by:

$$(\sigma_x)_{max} = \frac{6M_x}{t^2} \quad (\sigma_y)_{max} = \frac{6M_y}{t^2} \qquad (1)$$

where $t$ = thickness of the plate.

In the particular case where $M_x = M_Y = M$:

$$\frac{1}{r_x} = \frac{1}{r_y} = \frac{M}{D(1+\nu)} \text{ where } D = \frac{Et^3}{12(1-\nu^2)} \qquad (2)$$

$r_x$ = radius of curvature of the plate in $x$ direction
$r_y$ = radius of curvature of the plate in $y$ direction
$E$ = elastic modulus
$\nu$ = Poisson's ratio A standard approximation in the binding of plates is:

$$\frac{1}{r_x} = \frac{\delta^2\omega}{\delta_y^2} \quad \frac{1}{r_y} = \frac{\delta^2\omega}{\delta_y^2}$$

where $\omega = \omega(x, y)$ is an equation for the deflection of the plate.

In the case of a parabola:

$$\omega = \omega(x, y) = \frac{x^2+y^2}{4Z_o}$$

and therefore:

$$\frac{\delta^2\omega}{\delta_y^2} = \frac{\delta^2\omega}{\delta x^2} = \frac{1}{2Z_o}$$

where $Z_o$ = focal length $$\therefore r_x = r_y = 2Z_o \qquad (3)$$

Combining equations (1) and (2):

$$(\sigma_x)_{max} = \frac{6(1+\nu)}{r_x} \cdot \frac{Et}{12(1-\nu^2)}$$

$$= \frac{Et}{2r_x(1-\nu)}$$

Substituting equation (3) into the above equation:

$$(\sigma_x)_{max} = \frac{Et}{4Z_o(1-\nu)} \qquad (4)$$

This equation would apply for the configuration having greatly overlapping petals. For the configuration having fully overlapping petals, two petal sheets effectively act as one. Substituting $2t$ for $t$ in equation (4):

$$(\sigma_x)_{max} = \frac{Et}{2Z_o(1-\nu)} \qquad (5)$$

Appendix C

Figure 8:
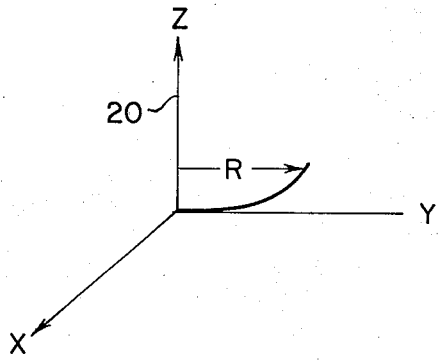
FIG. 8 is a three-dimensional view of a parabola as it rotates about the z-axis.

Referring to FIG. 8, for paraboloidal deflection in three dimensions, $$\delta = \left(\frac{x^2 + y^2}{4Z_o} - \frac{y^2}{4Z_o}\right)\cos\theta$$

where $\theta$ is given by $$\tan\theta = \frac{dz}{dy} = \frac{y}{2Z_o} \cong \frac{r}{2Z_o}$$

$$\text{and } \cos\theta = \frac{2Z_o}{\sqrt{r^2 + 4Z_o^2}}$$

$$\text{therefore } \delta = \frac{x^2}{4Z_o}\ \frac{2Z_o}{\sqrt{r^2 + 4Z_o^2}}$$

$$= \frac{x^2}{2\sqrt{r^2 + 4Z_o^2}}$$

$$\text{but } x = \frac{\pi D}{2n} = \frac{\pi r}{n}$$

$$\text{thus } \delta = \frac{\pi^2 r^2}{\sqrt{2n^2 + r^2 + 4Z_o^2}}$$

where
$n$ = number of petals
$r$ = radius of reflector
$Z_o$ = focal length of reflector

I claim:

1. A reflector for high-gain antenna comprising:

a plurality of generally planar triangular electromagnetically reflective petals having a longitudinal axis and rectilinear major edge shape; and means connecting the petals in edgewise substantially overlapping relation to form a reflector having a shape of a surface of revolution, each petal taking the form along its longitudinal axis of the line that generates the surface of revolution and generally curvilinear transverse form;

the connecting means including a plurality of paired fasteners coupling the overlapping edges of said petals through holes therein at predetermined locations with respect to the longitudinal axis of the petals which define the conformation of the assembled reflector.

2. A reflector as in claim 1 wherein the petals form a reflector of substantially paraboloid shape and each petal is generally of parabolic form along its longitudinal axis.

3. A reflector as in claim 2 wherein the petals, after connection by said connecting means, have a longitudinal form substantially in accordance with the relation $Z = r^2/4Z_o$ where $r$ is the radius of a parabola rotating about the Z-axis of a three-dimensional rectangular coordinate system and $Z_o$ is the focal length of the resulting parabolic surface of revolution, and have a transverse shape determined substantially in accordance with the relation.

$$\delta = \frac{\pi^2 r^2}{2n^2 \sqrt{r^2 + 2Z_o^2}}$$

where $\delta$ is the amount of curvilinear deflection from rectilinear transverse conformation and n is the number of petals.

4. A reflector as in claim 1 wherein the plurality of petals are in edgewise interlaced substantially overlapping relation.

5. A reflector as in claim 3 wherein $\delta$ is less than the thickness of the petal material.

6. A reflector as in claim 1 wherein:

a first plurality of petals are arranged in edgewise substantially abutting relation; and the connecting means includes a second plurality of essentially identical petals coupled to the first mentioned plurality of petals by the fasteners to form a second fully overlapping layer of petals;

said second layer of petals being effective for forming the first-mentioned plurality of petals into a reflector having substantially paraboloid shape.

7. A reflector as in claim 6 wherein the major shape of the petals is slightly curved outward from the longitudinal axis thereof.

8. A reflector as in claim 6 wherein each of the second plurality of petals have holes located essentially at the same positions relative to the longitudinal axis thereof as each of the first-mentioned plurality of petals.

* * * * *

UNITED STATES PATENT AND TRADEMARK OFFICE

CERTIFICATE OF CORRECTION

PATENT NO. : 3,971,023

DATED : July 20, 1976

INVENTOR(S) : Robert B. Taggart

It is certified that error appears in the above-identified patent and that said Letters Patent are hereby corrected as shown below:

Column 3, line 34, "bu" should read --but--; the portion of the equation appearing at the end of this column which reads " $\frac{r}{2Z_o}$ " should read -- $\frac{r}{2Z_o}$ --.

Column 4, line 43, "(9.2 fee)" should read -- (9.2 feet)--; at approximately line 50, that portion of the equation which reads " $\sqrt{1 + \frac{dZ}{dr}^2}\, dr$ " should read-- $\sqrt{1 + \frac{dZ}{dr}^2}\, dr$ --.

Column 6, at approximately line 46, the equation which reads "$R_1$ = Rcos [θ(1-b)]-A" should read --$R_1$ = Rcos [θ(1-B)]-A --; line 56, the word "prabolic" should read -- parabolic --.

Column 8, at approximately line 6, the equation which reads "$S_3$ = Rsin ]θ(1+2B)]" should read -- $S_3$ = Rsin [θ(1+2B)] --.

Appendix A, after the word "and", first occurrence, the portion of the equation which reads "0 x $\ell_1$" should read -- $0 \leq x \leq \ell_1$ --; after the word "and", first occurrence, the portion of the equation which reads "1 x 1" should read -- $\ell_1 \leq x \leq 1$ --; after the phrase "For the top beam", the portion of the equation which reads " $\frac{1}{2}$ $x_3x^2$ $\frac{2x}{}$ ]" should read -- $\frac{1}{2}$ x $x^2$ $\frac{2x}{3}$] --;

UNITED STATES PATENT AND TRADEMARK OFFICE

CERTIFICATE OF CORRECTION

PATENT NO. : 3,971,023

DATED : July 20, 1976

INVENTOR(S) : Robert B. Taggart

It is certified that error appears in the above-identified patent and that said Letters Patent are hereby corrected as shown below:

(2)

Appendix A (continued), after the phrase "For the bottom beam", the portion of the fourth equation which reads "$2x \frac{\ell_1 x^2}{2} - \frac{x^3}{6}$ )]" should read -- $2x \left( \frac{\ell_1 x^2}{2} - \frac{x^3}{6} \right)]$ --;

after the phrase "For the bottom beam", the portion of the sixth equation which reads "$2x( {}_1x - \frac{x^2}{2} = 0$" should read -- $2x(\ell_1 x - \frac{x^2}{2}) = 0$ --; after the word "Therefore," the portion of the sixth equation which reads "$\frac{16}{81}\ {}_1{}_1{}^3]$" should read -- $\frac{16}{81}\ \ell_1{}^3]$--; under the phrase "assume $\ell_1 = b$ " the portion of the first equation which reads "$-\left[\frac{2}{27} + \frac{4b}{81}\right]$" should read -- $\left[\frac{-2}{27} + \frac{4b}{81}\right]$ --; column 11, after the word "Simplifying", the the portion of the equation which reads "$(\frac{1-b}{b} + \frac{b\ell^2}{4}]$ " should read --$(\frac{1-b}{b}) + \frac{b\ell^2}{4}]$ --; column 11, after the word "and",

UNITED STATES PATENT AND TRADEMARK OFFICE

CERTIFICATE OF CORRECTION

PATENT NO. : 3,971,023

DATED : July 20, 1976

INVENTOR(S) : Robert B. Taggart

It is certified that error appears in the above-identified patent and that said Letters Patent are hereby corrected as shown below:

the equation which reads "$S_{max} = \frac{P\ell^3b^2}{27EI_Z}\left(\frac{4b}{3} - 2\right) = \frac{P\ell^3b^2}{81EI_Z}(4b-6)$"

should read -- $S_{max} = \frac{P\ell^3b^2}{27EI_Z}\left(\frac{4b}{3} - 2\right) = \frac{P\ell^3b^2}{81EI_Z}(4b-6)$ --.

Appendix B, column 11, at approximately line 29, the equation reads "$(\sigma_x)_{max} = \frac{6M_x}{t^2}(\sigma_y)_{max} = \frac{6M_y}{t^2}$" and should read -- $(\sigma_x)_{max} = \frac{6M_y}{t^2}$ $(\sigma_y)_{max} = \frac{6M_y}{t^2}$ --; column 11, line 41, the word "binding" should read -- bending --.

Appendix C, column 12, at approximately line 53, after the word "thus", "$\delta = \frac{\pi^2 r^2}{\sqrt{2n^2 + 4Z_o^2 r^2 +}}$" should read --

$$\delta = \frac{\pi^2 r^2}{2n^2\sqrt{r^2 + 4Z_o^2}}$$ --.

UNITED STATES PATENT AND TRADEMARK OFFICE

CERTIFICATE OF CORRECTION

PATENT NO. : 3,971,023

DATED : July 20, 1976

INVENTOR(S) : Robert B. Taggart

It is certified that error appears in the above–identified patent and that said Letters Patent are hereby corrected as shown below:

Figure 6b of the drawings should read:

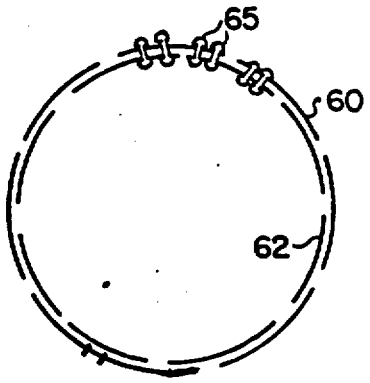

Figure 6b

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*